US005415450A

United States Patent [19]

Faxon

[11] Patent Number: 5,415,450

[45] Date of Patent: May 16, 1995

[54] LOAD LIFTER HOOK CONSTRUCTION

[76] Inventor: Jay Faxon, 29 Burke St., Haverhill, Mass. 01830

[21] Appl. No.: 197,840

[22] Filed: Feb. 17, 1994

[51] Int. Cl.[6] ..... B66C 1/26

[52] U.S. Cl. ..... 294/82.31

[58] Field of Search ..... 294/26, 66.1, 75, 81.56, 294/67.2, 82.1, 82.11, 82.17, 82.19, 82.24, 82.27, 82.31–82.36, 111, 112, 122–124

[56] References Cited

U.S. PATENT DOCUMENTS

| | | | |
|---|---|---|---|
| 316,857 | 4/1885 | Werum | 294/111 |
| 594,644 | 11/1897 | McCorkile | 294/67.2 |
| 992,746 | 5/1911 | Ashdown | 294/82.31 |
| 1,695,960 | 12/1928 | Hackworth et al. | 294/67.2 |
| 1,858,941 | 5/1932 | Salmon | 294/66.1 |
| 1,994,782 | 3/1935 | Olson | 294/82.31 X |
| 2,370,312 | 2/1945 | Herman | 294/82.31 |
| 2,680,644 | 6/1954 | Marconi | 294/67.2 |
| 2,780,487 | 2/1957 | Bredensteiner et al. | 294/81.56 |

FOREIGN PATENT DOCUMENTS

| | | | |
|---|---|---|---|
| 2325689 | 12/1973 | Germany | 294/81.56 |
| 198998 | 8/1990 | Japan | 294/82.31 |
| 922034 | 4/1982 | U.S.S.R. | 294/75 |
| 1096189 | 6/1984 | U.S.S.R. | 294/81.56 |
| 1211205 | 2/1986 | U.S.S.R. | 294/81.56 |

*Primary Examiner*—Johnny D. Cherry
*Attorney, Agent, or Firm*—Frederick R. Cantor

[57] ABSTRACT

A load lifting hook construction is equipped with a control eye that is attachable to a control rope that parallels a suspension rope. A person located above the lifting hook can selectively pull the suspension rope and control rope to manipulate the hook into, or out of, engagement with the load. The tip of the hook is spaced a relatively great distance from the suspension axis so that the hook has a relatively large mouth. The hook is also enabled to extend into relatively small openings in the load. A variety of different types of loads can be remotely controlled and lifted, using the hook structure of this invention.

1 Claim, 1 Drawing Sheet

LOAD LIFTER HOOK CONSTRUCTION

BACKGROUND OF THE PRESENT INVENTION

The present invention relates to a load lifter hook construction.

The present invention relates to a load lifter hook construction, and more particularly, a hook construction that can be manipulated from a remote point, to engage, or disengage, the load. The hook construction is especially suited for raising, or lowering equipment, tools, cans of paint, buckets and building materials between ground level and elevated locations on buildings under construction or repair. The present invention enables one man to safely raise or lower equipment for service work without having to climb up or down a ladder, and without having to risk injury caused by holding onto a ladder with one hand while holding onto a piece of equipment with the other hand.

The use of lifter hooks attached to ropes, or cables, for raising or lowering a load is well known. One problem with such lifter hooks is that a person may find it difficult to engage the hook with the load or to disengage the hook from the load. For example, a person standing on the roof of a building may have difficulty in swinging a hook on the lower end of a rope into engagement with a handle on a paint can or toolbox located at ground level. The hook will tend to twist, or swing, beyond the handle, instead of moving into the handle opening. Frequently, it is necessary to have a second person located at ground level for attaching the hook to the equipment that is to be lifted, or for removing the hook from the equipment after it has been lowered.

Hook structures capable of remote manipulation have been devised. For example, U.S. Pat. No. 2,523,434, issued to N. Johnson on Sep. 26, 1950, shows a cargo hook construction wherein the hook element is swingable and laterally slidable on a separate suspension element. A control rope is connected to the hook element for remote manipulation of the hook element out of engagement with the load.

Japanese Patent 0198998, issued in August 1990 to Hisato Nakahara, shows a hook construction having an auxiliary eye connected to a control rope so that when the load is at its final location the hook can be partially overturned to disengage the hook from the load.

U.S. Pat. No. 839,036, issued to H. Roberts on Dec. 18, 1906, shows a hook structure that is connectable to a control rope via a system of meshed sector gears and swingable links, whereby the hook element can be swung into engagement with the load.

SUMMARY OF THE PRESENT INVENTION

An object of the present invention is provide a load lifter hook construction.

Another object of the present invention is to provide a load lifter hook construction, having an auxiliary control eye connectable to a control rope, whereby the hook body can be rotated around its suspension point to swing the hook element into or out of engagement with the load. The hook construction can thus be remotely controlled, without need for the person to physically attach the hook to the load or remove the hook from the load.

The hook structure is designed to have a relatively large mouth, whereby the tip of the hook is better enabled to enter into a handle space or similar suspension opening on the load. Another advantageous feature is that the load-engagement wall of the hook element has a load engagement surface centered on a point at, or near, the hook suspension point, such that the tip of the hook element can move into the opening of the load device without having to move or disturb the load. The hook can thus be fully engaged with the load prior to the load-lifting operation.

In the preferred practice of the present invention, the hook is formed out of a single metal rod bent into the desired hook configuration. The control eye is a separate member welded onto an outer surface of the bent rod. The hook structure has a relatively low manufacturing cost.

In summary, and in accordance with the above discussion, the foregoing objectives are achieved in the following embodiments.

1. A load lifting hook construction, comprising a hook body having an upper end configured as a hook-suspension eye, an arcuate C-shaped wall located below said suspension eye, and a load-engagement wall extending from said C-shaped wall;

said hook body having a suspended position wherein the C-shaped wall and the load-engagement wall are located on opposite sides of a vertical suspension axis extending through the suspension eye;

a control eye located on said C-shaped wall remote from the vertical suspension axis;

said hook-suspension eye being connectable to a lifter rope, whereby the hook body is raisable and lowerable;

said control eye being connectable to a control rope, whereby the hook body can be rotated around the hook-suspension eye to swing the load-engagement wall into or out of engagement with a load; and said load-engagement wall having a tip that is spaced further away from the vertical suspension axis than the control eye when said hook body is in its suspended position.

2. The load lifting hook, as described in paragraph 1, wherein the spacing between the control eye and the vertical suspension axis is about one-half the spacing between the tip of the load-engagement wall and the vertical suspension axis when the hook body is in its suspended position.

3. The load lifting hook, as described in paragraph 1, wherein said load-engagement wall has a load surface centered on a point at or near said hook-suspension eye.

4. The load lifting hook, as described in paragraph 1, wherein said hook body is formed of a single metal rod.

5. The load lifting hook, as described in paragraph 1, wherein said control eye is located above a horizontal plane taken through the tip of the load-engagement wall when the hook body is in a suspended position.

DESCRIPTION OF THE PREFERRED EMBODIMENT OF THE PRESENT INVENTION

Figure 1:
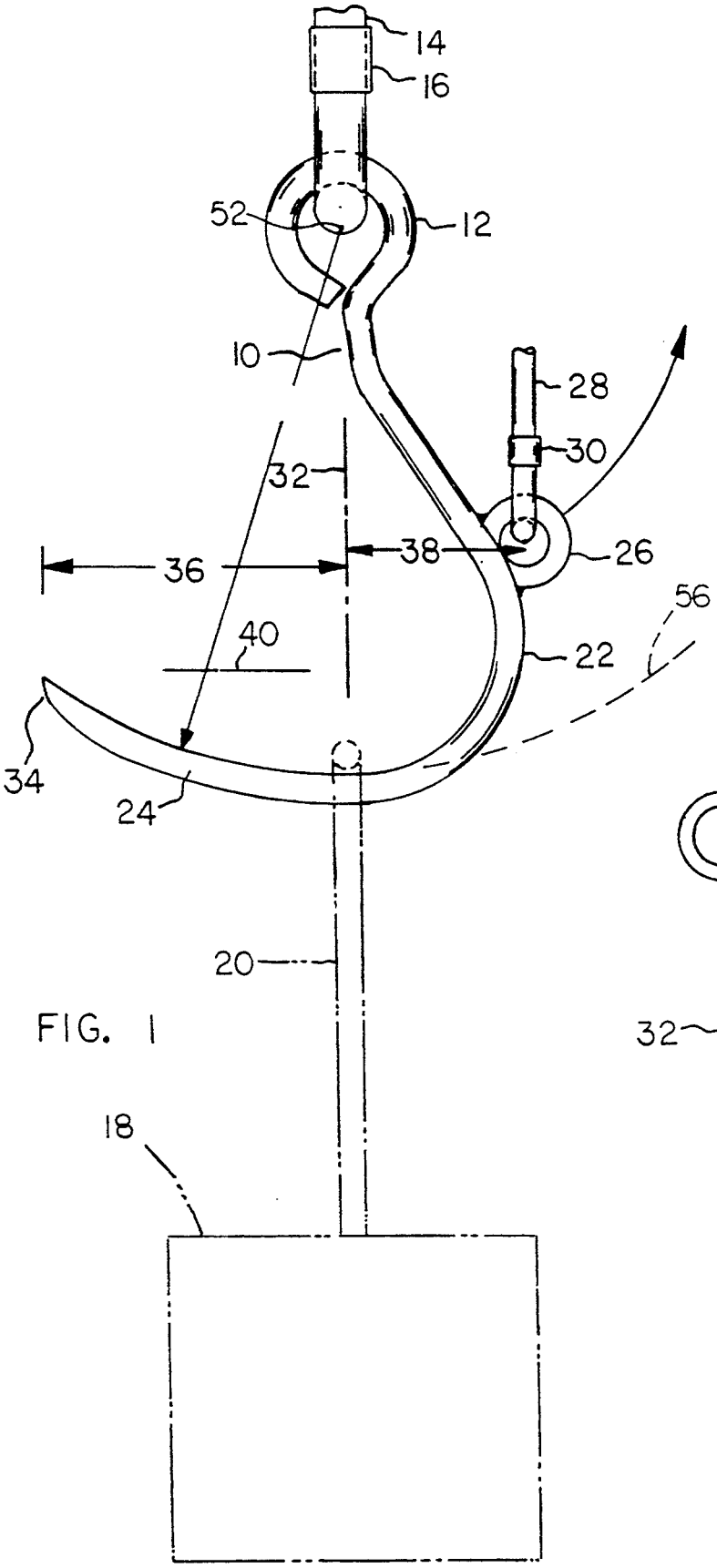
FIG. 1, is a side elevational view of a lifter hook embodying features of the present invention.

The drawings show a load lifting hook construction 10 formed out of a steel rod bent into a desired hook configuration. The steel rod forms a hook body whose upper end provides a hook-suspension eye 12. A lifter rope 14, extends through eye 12, so that its free end is clamped to the rope surface by a metal band 16, whereby the rope 14 is attached to the hook 10. The other end of the lifter rope 14 will be held by a person at an elevated location on a building, whereby the person can raise, or lower, the hook 10 during a load-lifting or load-lowering operation. In the drawing the load is designated by numeral 18. A handle 20 is provided on the load 18 for engagement with hook 10.

The hook body comprises a curved C-shaped wall 22, and a load-engagement wall 24. Wall 24 may have a slight curvature centered on a point at, or near, the center of suspension eye 12, such that wall 24 can move into, or out of, the opening in handle 20 without striking against the handle 20, or disturbing the position of load 18.

A second control eye 26 is carried on the outer surface of arcuate C-shaped wall 22 for connection to a control rope 28. The control rope 28 can have its lower end portion inserted through the control eye 26 and clamped to the rope 28 side surface, by means of a metal band 30. The upper end of the control rope 28, not shown, will be held by the person in an elevated location, where the lifting, or lowering, operation is being controlled.

FIG. 1, shows the hook 10 in its suspended position, wherein the weight of the hook is distributed essentially evenly on opposite sides of a vertical suspension axis 32, passing through suspension eye 12. Arcuate wall 22 is located generally to the right of suspension axis 32, whereas load-engagement wall 24 is located to the left of suspension axis 32.

Figure 2:
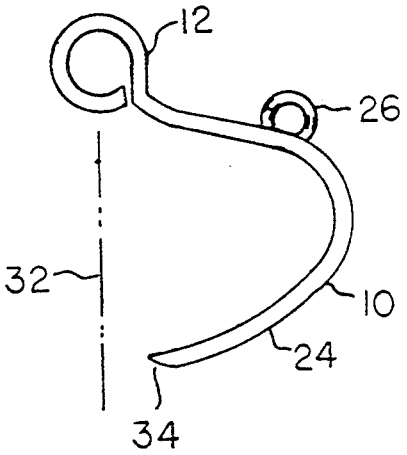
FIG. 2, is another view of the FIG. 1 hook, taken on a reduced scale, and showing the hook in a different position of adjustment.

The hook 10 may be initially connected to the load 18 by moving the lifter rope 14 so that the hook 10 is directly above handle 20. Control rope 28 can be pulled upwardly to swing hook 10 around suspension eye 12, whereby hook 10 assumes the position depicted in FIG. 2. By slightly lowering the lifter rope 14 and then lowering control rope 28, the hook 10 will swing in a clockwise arc so that load-engagement wall 24 enters into the opening in handle 20.

This clockwise arcuate motion of the hook 10 will be carried out prior to the load-lifting operation. The hook 10 will thus be firmly engaged with the load 18 prior to the lifting operation. Due to the fact that load-engagement wall 24 has an arc centered on a point at, or near, suspension eye 12, the arcuate motion of wall 24 will occur without disturbing the position of load 18.

The load 18 is lifted by pulling upward on lifter rope 14. It is not necessary to exert any force on control rope 28, since the load force will keep the hook 10 in the FIG. 1 position.

Hook 10 can also be remotely disengaged from the load 18, e.g., after the load 18 has been lowered from an elevated location. With lifter rope 14 in a reasonably taut condition, a lifting, or pulling force, can be applied to control rope 28, thereby swinging the hook 10 in a counterclockwise arc to the FIG. 2 position.

The hook 10 is designed so that when the hook 10 is in its FIG. 1 position, the tip 34 of load-engagement wall 24, is spaced from suspension axis 32 by a distance 36, that is appreciably greater than the distance 38 from control eye 26 to suspension axis 32. Preferably distance 36 is about twice the distance 38. This relationship gives the hook a relatively wide mouth, whereby the tip 34 of load-engagement wall 24 is better enabled to mate with the lifter opening in the load 18.

Control eye 26 can have various different locations on the outer surface of arcuate wall 22. As shown, control eye 26 is located a slight distance above an imaginary plane 40 taken through tip 34 of the load-engagement wall 24. Eye 26 is reasonably close to suspension eye 12, so that the hook 10 can be swung around the suspension eye axis with a relatively small lifting motion of the control rope 28.

As previously noted, the hook 10 is formed out of a single steel rod bent into a desired hook configuration. Control eye 26 is formed separately, and welded to the exterior surface of arcuate wall 22. The manufacturing cost of the hook is, therefore, relatively low.

The present invention describes a load lifter hook construction. Features of the present invention are recited in the appended claims. The drawings herein necessarily depict specific structural features and embodiments of the load lifter hook construction, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for the purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A load lifting hook construction usable for lifting and lowering equipment between ground level and elevated locations on buildings, said load lifting hook construction comprising, a single hook body having an upper end configured as a hook-suspension eye, an arcuate C-shaped wall located below said suspension eye, and a load-engagement wall extending from said C-shaped wall;

said hook body having a suspended position wherein the C-shaped wall and the load-engagement wall are located on opposite sides of a vertical suspension axis extending through the suspension eye;

a control eye located on said C-shaped wall remote from the vertical suspension axis;

said hook-suspension eye being connectable to a manually operated lifter rope, whereby the hook body is raisable and lowerable;

said control eye being connectable to a manually-operated control rope, whereby the hook body can be rotated from a remote point in either direction around the hook-suspension eye to swing the load-engagement wall into or out of engagement with equipment that is to be lifted and lowered;

said load-engagement wall having a tip adapted to pass freely through a suspension opening in the equipment that is to be lifted and lowered;

said tip being spaced further away from the vertical suspension axis than the control eye when said hook body is in its suspended position; and said load-engagement wall having an arcuate load surface centered on an axis extending transversely through said hook-suspension eye.

* * * * *